United States Patent [19]

Morgan

[11] 4,312,557

[45] Jan. 26, 1982

[54] ELECTRICAL FUSEHOLDER

[75] Inventor: John T. Morgan, Waltham Cross, England

[73] Assignee: Pye (Electronic Products) Limited, Cambridge, England

[21] Appl. No.: 124,402

[22] Filed: Feb. 25, 1980

[30] Foreign Application Priority Data

Feb. 27, 1979 [GB] United Kingdom ..... 06833/79

[51] Int. Cl.[3] ..... H01R 13/68

[52] U.S. Cl. ..... 339/130 R; 339/147 R; 339/252 F

[58] Field of Search ..... 337/228; 339/130 R, 339/130 C, 147, 150 F, 206 R, 217 S, 252 F, 253 F, 256 C, 258 F, 259 F, 262 F, 263 L, 265 F, 266 F, 270 F

[56] References Cited

U.S. PATENT DOCUMENTS

| | | | |
|---|---|---|---|
| 2,668,888 | 2/1954 | Johnson | 339/147 P |
| 2,989,610 | 6/1961 | Linton | 339/258 F |
| 3,340,497 | 9/1967 | Balint | 339/217 S |
| 3,609,654 | 9/1971 | Wallo | 339/217 S |
| 3,659,252 | 4/1972 | Brown | 339/147 R |

FOREIGN PATENT DOCUMENTS

| | | | |
|---|---|---|---|
| 2348306 | 3/1974 | Fed. Rep. of Germany | 339/256 C |
| 1159999 | 7/1969 | United Kingdom | 339/147 R |

*Primary Examiner*—John McQuade

*Attorney, Agent, or Firm*—Thomas A. Briody; William J. Streeter; Rolf E. Schneider

[57] ABSTRACT

A panel-mountable fuseholder for a cartridge fuse comprises a substantially cylindrical body open at one end and closed at the other end. The fuseholder is provided with an electrical contact comprising an annular first portion, a second portion extending substantially perpendicular to the plane of the annulus and having a terminal outside the body of the fuseholder, and a third portion extending substantially perpendicular to the plane of the annulus on the same side of the plane as the second portion. The second portion has a projecting tongue which engages the fuseholder body to retain the contact therein. The third portion resists the tendency of the contact to tip and become dislodged when the terminal of the second portion is bent away from the fuseholder body to facilitate soldering of a lead to such terminal.

3 Claims, 6 Drawing Figures

ELECTRICAL FUSEHOLDER

Figure 1:
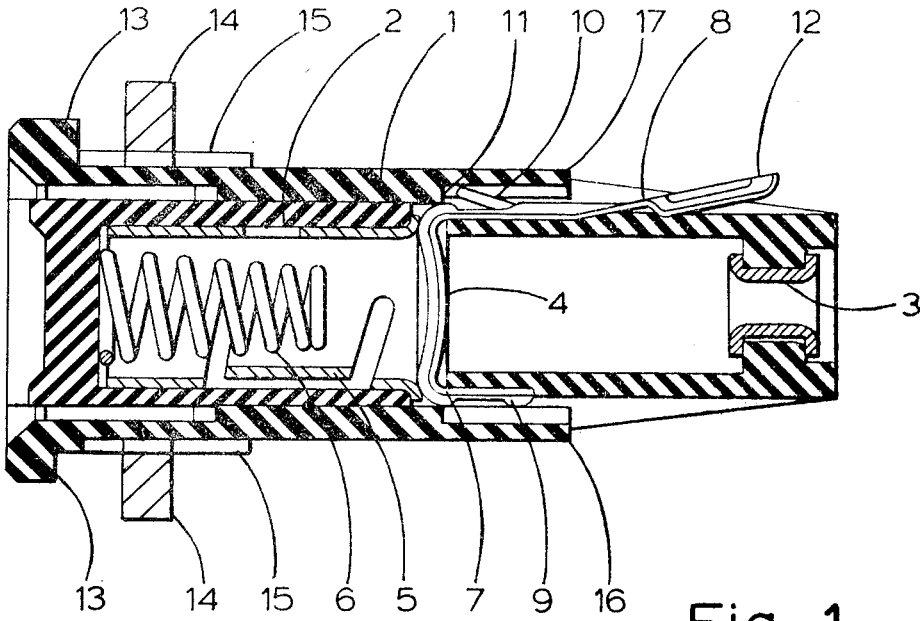

This invention relates to a panel mountable electrical fuseholder for a cartridge fuse element comprising a substantially cylindrical body open at one end and a closure member, the body being provided with a first electrical contact adjacent to its closed end and a second electrical contact intermediate the open and closed ends along its length, the first and second contacts being arranged to make electrical contact with respective end caps of a fuse element, wherein one end cap of the fuse element is gripped within the closure member and when the closure member is inserted into the body the fuse element projects through the second electrical contact so that the other end cap contacts the first electrical contact, the one end cap being electrically connected to the second electrical contact by a third electrical contact positioned in the closure member and wherein the second electrical contact comprises an annular first portion and a second portion which extends, substantially perpendicular to the plane of the annulus, outside the cylindrical body, is provided with a resilient latching tongue for retaining the second electrical contact in position in the cylindrical body and forms terminal means for connecting the one end of the fuse element into an electrical circuit.

In such a fuseholder it is usual to connect the fuseholder into an electrical circuit by means of soldering leads to terminal portions of the first and second electrical contacts. Frequently the terminal portion of the second contact is bent away from the body of the fuseholder in order to ease the task of attaching the lead to be soldered to it. This can result in the second contact being displaced within the body and consequently in faulty operation of the fuseholder since if the second contact becomes displaced towards the open end of the body it may become unsafe due to the possibility of touching it when live or it may prevent proper mating of the closure member and the body.

It is an object of the present invention to provide such a fuseholder in which the possibility of displacement of the second electrical contact when the portion which extends outside the body is flexed is reduced.

It is a further object of the invention to provide an electrical contact suitable for use as the second contact in such an electrical fuseholder.

The invention provides a panel mountable electrical fuseholder for a cartridge fuse element as described above, characterised in that the second electrical contact has a third portion which extends substantially perpendicular to the plane of the annulus on the same side of the plane as the second portion and which in co-operation with the cylindrical body is effective to resist movement of the second electrical contact when the second portion is bent away from the body.

In order to reduce the possibility of unauthorised tampering with the fuseholder the latching tongue may be located within the cylindrical body. This makes it difficult to remove the second contact without the use of an appropriate tool. The third portion may extend outside the body and include a resilient latching tongue for further retaining the second contact in the cylindrical body. The third portion may also form terminal means for connecting the one end cap of the fuse element into an electrical circuit. The second and third portions may extend from diametrically opposite positions on the annular portion. This is the most effective construction for restricting the movement of the second contact.

The invention further provides an electrical contact suitable for use as the second contact in such an electrical fuseholder comprising an annular first portion, comprising a second portion which extends substantially perpendicular to the plane of the annulus, outside the cylindrical body when in use, is provided with a resilient tongue for retaining the second electrical contact in position in the cylindrical body when in use, and forms terminal means for connecting the one end of the fuse element into an electrical circuit, and comprising a third portion which extends substantially perpendicular to the plane of the annulus on the same side of the plane as the second portion and which in co-operation with the cylindrical body when in use is effective to resist movement of the second electrical contact when the second portion is bent away from the body.

The third portion may also be arranged for connection to an electrical circuit, and may be made identical to the second portion. The second and third portions may extend from diametrically opposite positions on the annulus.

Figure 2:
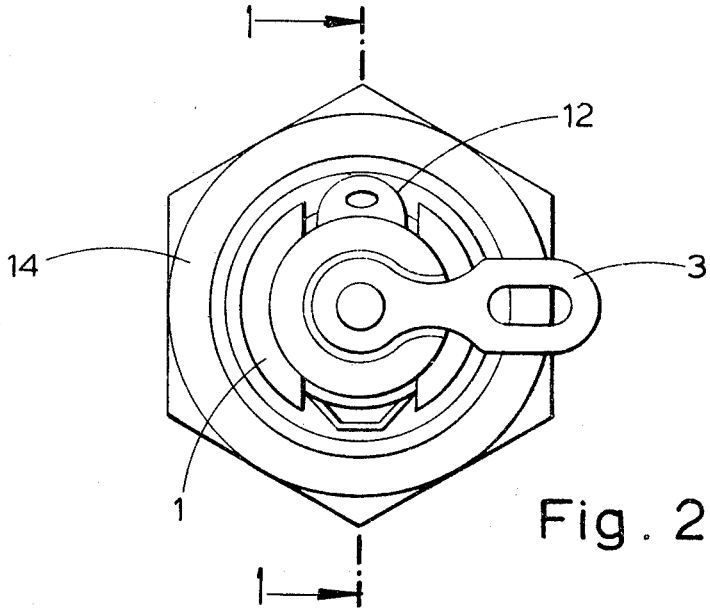
Figure 3:
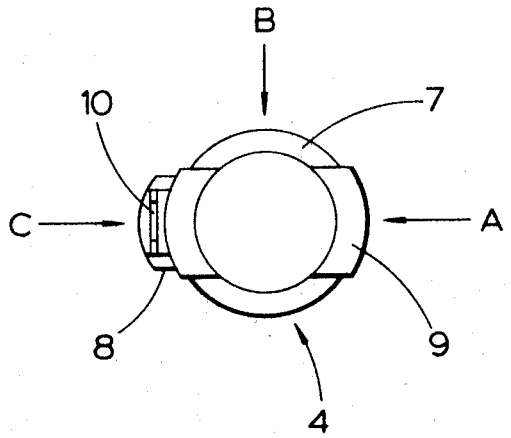
Figure 4:
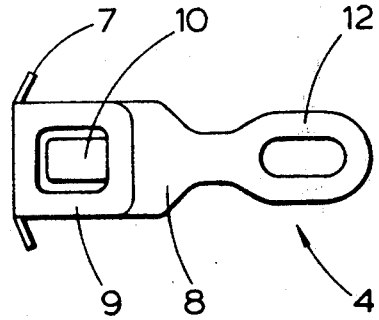
Figure 5:
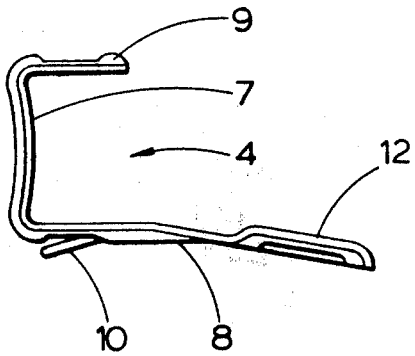
Figure 6:
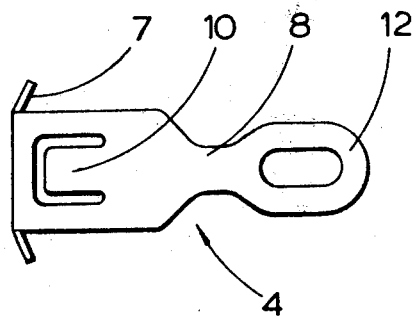

The invention will now be described in detail with reference to the accompanying drawings, in which:

FIG. 1 shows a cross sectional elevation taken along the line 1—1 of FIG. 2 of an electrical fuseholder according to the invention, FIG. 2 is an end elevation of the fuseholder shown in FIG. 1, FIG. 3 is a plan view of an electrical contact according to the invention, FIG. 4 is an elevation looking in the direction of arrow A of the contact shown in FIG. 3, FIG. 5 is an elevation looking in the direction of arrow B of the contact shown in FIG. 3, and FIG. 6 is an elevation looking in the direction of arrow C of the contact shown in FIG. 3.

As shown in FIGS. 1 and 2 the electrical fuseholder comprises a hollow substantially cylindrical body 1 closed at one end and a closure member 2. A first electrical contact 3 is provided at the closed end of the body 1 while a second electrical contact 4 is provided intermediate the open and closed ends along the length of the body 1. A cartridge fuse (not shown) is gripped within the closure member 2 by a third electrical contact 5 and when the closure member is screwed home the third contact 5 engages the second contact 4 to complete an electrical circuit between first and second contacts 3 and 4 via the cartridge fuse. A spring 6 biasses the cartridge fuse against the first contact 3.

The second contact 4 which is shown in greater detail in FIGS. 3 to 6 comprises an annular first portion 7, a second portion 8 which extends substantially perpendicular to the plane of the annulus and a third portion 9 which also extends substantially perpendicular to the plane of the annulus on the same side of the plane as the second portion 8. The second portion 8 is provided with a resilient latching tongue 10 which engages behind a shoulder 11 in the fuseholder body 1 to lock the second contact 4 in the body. The portion 8 is also provided with a terminal portion 12 to which a lead may be soldered.

The fuseholder is designed for mounting through an aperture in a panel, the panel being gripped between a shoulder 13 on the body and a lock nut 14 which engages with a screw threaded portion 15 on the body 1.

When leads are soldered to the fuseholder it is usual to bend the terminal portion 12 away from the body 1 in order to obtain easier access for wrapping the bared portion of the lead round the terminal portion 12 and for applying a soldering iron to the joint. In prior constructions this has resulted in occasional dislodgement of the latching tongue 10 from the second shoulder 11 and thus displacement of the contact 4 along the length of the fuseholder body 1. By providing the third portion 9 the second tendency of the contact 4 to be dislodged when the terminal portion 12 is bent outwards is reduced, the third portion 9 resisting the second tendency of the terminal contact 4 to tip as the portion 12 is bent outwards.

The second and third portions 8 and 9 are preferably provided at diametrically opposite positions on the annular first portion 7 as this gives the most effective resistance to movement of the second contact 4 for a given width of portions 8 and 9. It is however, possible to locate the second and third portions 8 and 9 at other positions around the annulus and provided that they extend over more than a quadrant of the annulus they will offer some resistance to dislodgement of the second contact 4. As shown the third portion 9 is formed to be located within the skirt portion 16 of the body 1 but it can take the second same form as the portion 8 complete with locking tongue and terminal portion if desired.

A further skirt portion 17 which covers the latching means formed by the tongue 10 and the shoulder 11 is provided on the body 1 to prevent release of the second contact 4 without the use of a tool. In previously known constructions the latching means has been formed by a tongue which engaged an external shoulder on the body and hence could be released manually.

I claim:

1. A panel-mountable fuseholder for a cartridge fuse, which comprises a substantially cylindrical body open at one end and closed at the other end; a closure member for the open end; a first electrical contact adjacent to the closed end; a second electrical contact intermediate the open end and the closed end, said second contact having an annular first portion, a second portion extending substantially perpendicular to the plane of the annulus outside the cylindrical body and being provided with a resilient latching tongue for retaining said second contact in position with respect to the cylindrical body and terminating in means for connection into an electrical circuit, and a third portion extending substantially perpendicular to the plane of the annulus on the same side of the plane as the second portion and arranged to co-operate with the cylindrical body to resist movement of the second contact when its second portion is bent away from the cylindrical body; the first contact and the second contact being arranged to make an electrical connection with the respective end caps of a cartridge fuse when one end cap of the cartridge fuse is gripped within the closure member and the closure member is inserted into the cylindrical body with the cartridge fuse projecting through the annular first portion of the second contact; and a third electrical contact in the closure member for electrically connecting said one end cap to the second contact.

2. A fuseholder according to claim 1, in which the second portion and the third portion of the second contact extend from diametrically opposite positions on the annular portion.

3. A fuseholder according to claim 1 or 2, in which the latching tongue is located within the cylindrical body.

* * * * *